US006996919B2

(12) United States Patent
Joseph

(10) Patent No.: US 6,996,919 B2
(45) Date of Patent: Feb. 14, 2006

(54) PROCESS FOR OBTAINING DRY EXTRACTS UNDER MILD CONDITIONS

(75) Inventor: Heinz-Walter Joseph, Berg (DE)

(73) Assignee: Bionorica AG, Neumarkt/Opf. (DE)

( * ) Notice: Subject to any disclaimer, the term of this patent is extended or adjusted under 35 U.S.C. 154(b) by 151 days.

(21) Appl. No.: 10/471,308

(22) PCT Filed: Mar. 12, 2002

(86) PCT No.: PCT/EP02/02714

§ 371 (c)(1),
(2), (4) Date: Feb. 23, 2004

(87) PCT Pub. No.: WO02/073108

PCT Pub. Date: Sep. 19, 2002

(65) Prior Publication Data

US 2004/0128852 A1 Jul. 8, 2004

(30) Foreign Application Priority Data

Mar. 12, 2001 (DE) ..... 101 12 167

(51) Int. Cl.
*F26B 5/94* (2006.01)

(52) U.S. Cl. ..... 34/406; 34/409; 34/92; 424/745; 514/783

(58) Field of Classification Search ..... 34/406, 34/409, 92, 291; 424/725, 745; 514/783
See application file for complete search history.

(56) References Cited

U.S. PATENT DOCUMENTS 3,300,868 A 1/1967 Anderwert
5,939,071 A * 8/1999 Joseph ..... 34/406
6,068,816 A 5/2000 Joseph

FOREIGN PATENT DOCUMENTS

| | | | |
|---|---|---|---|
| DE | 28 49 862 | A1 | 5/1980 |
| DE | 100 04 860 | A1 | 10/2000 |
| EP | 0 530 833 | A1 | 3/1993 |
| EP | 0 628 331 | A1 | 12/1994 |
| EP | 0 753 306 | A1 | 1/1997 |
| EP | 1 010 461 | A1 | 6/2000 |

OTHER PUBLICATIONS

International Search Report, Application No. PCT/EP 02/02714 dated Mar. 3, 2002.
English Translation of Form PCT/ISA/210.

* cited by examiner

*Primary Examiner*—Jiping Lu
(74) *Attorney, Agent, or Firm*—RatnerPrestia

(57) ABSTRACT

The invention concerns a method for obtaining dry plant extracts under mild conditions, in which a liquid plant extract is introduced into a vacuum drying equipment having a multi-shaft stirrer extending through a cylindrical mixing and drying chamber and with its own drive, together with a chopper rotating through a stator, and the liquid plant extract is dried at a vessel shell temperature of 20° C. to 50° C., a product temperature between 20° C. and 40° C., a pressure between 0.5 and 1,000 mbar, a stirrer rotation speed of greater than 0 to 10 rpm and a chopper rotation speed of 200 to 800 rpm, characterized in that the liquid plant extract is sprayed into the mixing and drying chamber through at least one nozzle above the liquid level in the latter, at a pressure differential of >100 mbar between the drying chamber and the reservoir, whereby the nozzle(s) each create(s) a droplet spray cone of ≧30° in at least one spatial direction, the average droplet size of the liquid plant extract sprayed in is ≦300 μm and the discharge capacity of the nozzle(s) is smaller than or equal to the evaporator capacity the drying equipment.

14 Claims, No Drawings

PROCESS FOR OBTAINING DRY EXTRACTS UNDER MILD CONDITIONS

This Application is a U.S. National Phase Application of PCT International Applicaiton PCT/EP02/02714.

The present invention concerns a process to obtain dry extracts under mild conditions, especially dry extracts of plants, and most particularly dry extracts of plants that foam.

Dry extracts of plants are usually manufactured by extracting a plant material using a solvent or solvent mixture, for example by means of maceration or percolation and, after separating off the extraction residue, evaporating down to dryness the fluid extract or tincture that is obtained.

Conventional drying methods include fluid bed drying or evaporating down to a thick or concentrated extract and afterwards vacuum belt drying or tray-drying this concentrated extract.

A process for drying under mild conditions to obtain dry extracts of plants with an elevated content of essential oils and phenols is described in EP-B-0 753 306. According to the method described there, the fluid extract or tincture obtained from the vegetable materials in the extraction is introduced into a vacuum drying system having a multi-shaft stirrer extending through a cylindrical mixing and drying chamber and with its own drive, also provided if necessary in each case with a vapour filter, back-washing device, solvent condenser with after-cooler and collection vessel, reflux condenser and a process, control and regulating unit, together with granulating nozzles if necessary, and is dried in the dryer which is equipped with a chopper extending through the entire depth of the mixing and drying chamber with knives rotating through a comb-shaped stator, at an input and recycle temperature between 120° C. and 5° C., an internal temperature between 10° C. and 80° C., an overhead vapour temperature of 15° C. to 55° C. and a pressure between 0.5 and 1000 mbar, as well as a stirrer rotation speed of 0 and 10 rpm and a chopper rotation speed between 200 and 800 rpm. With regard to further features of the apparatus and preferred drying conditions, reference is made to this patent document whose content is hereby incorporated by reference. Vacuum drying systems used according to EP-B-0 753 306 are marketed commercially for example by the Inox-Maurer AG Company under the designation IUT.

In these equipments, in a batch process the fluid extract to be dried is pumped into the mixing and drying chamber from the top and afterwards a vacuum is applied. When continuous operation is required, the fluid extract to be dried is pumped into the mixing and drying chamber below the level of the liquid filling.

Although the drying process described in EP-B-0 753 306 already speeds up the drying process considerably compared to conventional methods, and a reduced loss of essential oils and phenols is also achievable, it would be desirable to reduce these losses still further. An additional disadvantage of the drying process under mild conditions described above is that it does not allow the drying of foaming fluid extracts. This is because the interaction of the stirrer and the chopper when the vacuum is applied causes the material to foam severely, with the result that the foam is withdrawn together with the overhead product, breaks through and clogs up the drying system. Moreover, severe foaming entails the denaturing and loss of plant constituents that may possibly be wanted, and severe foaming is undesirable for this reason as well. Thus hitherto it was impossible to subject liquid plant extracts containing highly foaming constituents to the drying process under mild conditions according to EP-B-0 753 306.

Therefore the task of the present invention is to provide a process that enables dry extracts of plants with foaming constituents to be obtained under mild conditions and/or which enables a further acceleration of the drying method known from EP-B-0 753 306.

This task is solved according to the invention by a process to obtain dry extracts of plants under mild conditions according to EP-B-753 306 in which the liquid plant extract is sprayed through at least one nozzle into the mixing and drying chamber above the level of material therein and at a pressure differential of >100 mbar between the drying chamber and the reservoir, whereby the nozzle(s) each generate(s) a droplet spray cone of ≧30° in at least one spatial direction, the average droplet size of the liquid plant extract sprayed in is ≦300 μm and the discharge capacity of the nozzle(s) is smaller than or equal to the evaporator capacity of the drying equipment.

Accordingly the process of the invention differs from the method known previously in that the liquid plant extract is introduced into the mixing and drying chamber in a specific way.

More precisely, according to the invention a finely divided introduction takes place through at least one nozzle above the level of the material in the mixing and drying chamber.

For example provision can be made to use several nozzles (2 to 10, preferably 2 to 4 nozzles) to introduce uniformly over the volume of the mixing and drying chamber. These (nozzles) can be arranged in series or in clusters, whereby arrangements that enable a uniform wetting of the chamber are preferred.

Each nozzle generates in at least one spatial direction a droplet spray cone of ≧30° , preferably ≧60° and most preferably ≧90°. Rotationally symmetrical spray cones such as circular hollow cones or solid cones are more preferable. The choice of the appropriate cone shape depends on the shape of the mixing and drying chamber, the number of nozzles and the evaporator capacity of the drying equipment.

For example if the drying equipment has a large evaporator capacity and the number of nozzles is large, a linear arrangement of nozzles and the formation of a spray cone in a plane at right angles to the row of nozzles may be preferred. With a smaller number of nozzles in the same arrangement, again with a large evaporator capacity, the generation of solid cones may be preferable, but with a smaller evaporator capacity the generation of hollow cones may be preferred.

As already described, the nozzles used according to the invention generate a droplet spray cone of ≧30° to subdivide and distribute finely the liquid plant extract that is pumped in. The average droplet size of the liquid plant extract that is sprayed in is of droplets measuring ≦300 μm, preferably ≦150 μm and even more preferably ≦100 μm. The smaller the droplets, the larger is the surface area over which vaporisation takes place, and therefore the quicker the drying. Conversely, the smaller droplet size requires a higher differential pressure, and so in this respect lower limits are set to the droplet size.

The discharge capacity regarded as the sum across all the nozzles is smaller than or equal to the evaporator capacity of the drying equipment, to avoid accumulation of liquid material in the mixing and drying chamber. With a mixing and drying chamber volume of 2000 litres and an evaporator capacity of >300 l/h, the discharge capacity as the sum across all the nozzles is for example <250 l/h, preferably ≦150 l/h and most preferably ≦120 l/h. However, optimising the discharge capacity of the nozzles is within the ability of the person skilled in the art and must be adapted to the vacuum drying equipment used in each case by means of the usual routine procedures based on the pre-defined parameters.

To transport the liquid plant extract through the nozzle and to bring about the formation of spray cones and droplets, the extract is introduced into the mixing and drying chamber at a pressure differential of >100 mbar between the drying chamber and the reservoir. This differential pressure can be generated by applying an external pressure and/or by applying a vacuum to the mixing and drying chamber. It is preferable to generate the differential pressure exclusively by applying a vacuum to the mixing and drying chamber, while the reservoir and/or supply pipe for the liquid extract is at normal pressure. Preferably the pressure difference is ≧500 mbar, even more preferred is ≧900 mbar.

The drying itself usually takes place at a vessel shell temperature of 20° C. to 50° C. and a product temperature between 20° C. and 40° C. together with a pressure between 0.5 and 1000 mbar. Preferably the vessel shell temperature is from 20° C. to 45° C. and most preferably 20° C. to 40° C. The product temperature preferably lies between 20 and 30° C., and most preferably at 25° C. The pressure is preferably 5 to 100 mbar, especially preferably 30 to 70 mbar.

Basically the liquid plant extract can be sprayed in at any temperature, provided that it is liquid at this temperature. The upper limit to the temperature at which the plant extract is sprayed in is set by the decomposition temperature of the required plant constituents. Since the pressure of the drying chamber is less than the pressure of the liquid plant extract before being passed through the nozzle, the liquid plant extract depressurises after being sprayed into the mixing and drying chamber. This causes the liquid plant extract to cool down. Therefore, immediately before being sprayed in, the temperature at which the liquid plant extract is sprayed in is preferably greater than or equal to the product temperature. The temperature of the liquid plant extract before spraying in can also be higher than or equal to the vessel shell temperature, provided that this temperature does not exceed the decomposition temperature of the corresponding constituents. Preferably the temperature at which the liquid plant extract is sprayed in lies between 20 and 120° C., more preferably between 30 and 100° C. and most preferably between 30 and 80° C. Preferably the extract is not heated to the required temperature until immediately before being sprayed in.

The nozzles that are to be used can involve single nozzles or multiple nozzles with at least 2 channels, preferably 2 to 4 and most preferably 2 channels. At least two different liquid plant extracts, and a maximum number of different plant extracts equal to the number of channels, can be introduced into the mixing and drying chamber simultaneously and/or consecutively via the multiple nozzles. This enables mixed dry extracts of different origins to be prepared. Self-evidently it is also possible to spray in only one extract through all the channels of a multiple nozzle.

Basically any liquid plant extract can be dried by the present method. Examples of this include liquid plant extracts containing active ingredients such as essential oils (terpenes), phenols, lignins, polysaccharides, proteins, carotenes, lipids, acids, betaines etc. However, it is preferable to use the process according to the invention to dry plant extracts containing constituents that foam. Foam-forming constituents of this kind can involve saponins, soaps, polysaccharides, lignins, phenols, waxes and/or proteins. Preferably the foam-forming constituents represent saponins, soaps and/or proteins.

The liquid plant extract can be obtained from the whole plant or parts such as flowers (blossom), leaves, stems, roots and fruits or mixtures thereof. The liquid plant extract involves for example an extract of *Echinacea* (coneflower), *Salvia officinalis* (sage), *Agnus Castus* (Abraham's balm), *Allium cepa* (onion), *Rosmarinus officinalis* (rosemary), *Thymus vulgaris* (thyme), *Origanum maiorana* (marjoram), *Camomilla recutica* and *Anthemis nobilis* (camomile), Camphora (camphor), *Mentha piperita* (peppermint), *Mentha* (mint), *Piperis* (pepper), *Pinus* (pine, mountain pine), citrus fruits such as orange, lime and lemon, *Melissa officinalis* (melissa), *Hedera Helix, Hippocastanus* (horse chestnut), *Curcuma* (turmeric), *Galphimia Glauca, Cinnamomum* (cinnamon), *Cimicifuga* (Black cohosh, Black snakeroot), *Primula* (primula, primrose), *Valeriana officinalis* (valerian), *Gentiana* (gentian), *Plantaginus* (plantain), *Phytolacca americana, Belane Canda* and mixtures thereof. Preferably the liquid plant extract is an extract of *Cimicifuga* (Black cohosh, Black snakeroot), *Primula* (primrose, primula), *Valeriana officinalis* (valerian), *Gentiana* (gentian), *Plantaginis* (plantain), *Phytolacca americana, Belamcanda* or mixtures thereof. Extracts of *Cimicifuga, Plantaginus* or *Phytolacca americana* are involved most preferentially.

In the case of the process according to the invention, an initial charge of a dry material can be placed in the mixing drying chamber before spraying in the liquid plant extract. Astonishingly, the speed of drying can be increased even further and/or the tendency to form foam can be reduced still further by spraying the liquid plant extract onto this dry material. The dry material is preferably chosen from the group consisting of the usual adjuvants and excipients, dry plant extract(s) and mixtures thereof. The usual adjuvants and excipients can be selected from the group consisting of acrylic and methacrylic derivatives, alginic acid, sorbic acid derivatives such as alpha-octadecyl-omega-hydroxypoly-(oxyethylene)-5-sorbic acid, amino acids and their derivatives, especially amine compounds such as choline, lecithin and phosphatidylcholine, gum arabic, flavourings, ascorbic acid, carbonates such as for example sodium, potassium, magnesium and calcium carbonate and bicarbonate, hydrogen-phosphates and phosphates of sodium, potassium, calcium and magnesium, carmellose sodium, dimethicone, colouring agents, flavouring agents, preservatives, thickeners, plasticisers/softening agents, gelatine, glucose syrups, silicon dioxide (silica), preferably highly disperse silicon dioxide, hydromellose, benzoates, especially sodium and potassium benzoates, macrogol, magnesium oxide, fatty acids and their derivatives and salts such as stearic acid and stearates, especially magnesium and calcium stearate, fatty acid esters and mono- and di-glycerides of foodstuff fatty acids, natural and artificial waxes such as beeswax, yellow wax and montan glycol wax, chlorides, especially sodium chloride, polyvidone, polyethylene glycols, polyvinyl pyrrolidone, povidone, oils such as castor oil, soya oil, coconut oil and palm kernel oil, sugars and sugar derivatives, especially mono- and di-saccharides such as glucose, fructose, mannose, galactose, lactose, maltose, xylose, saccharose (sucrose), dextrose and cellulose and their derivatives, starches and starch derivatives, especially maize starch (cornstarch), shellac, talcum, titanium dioxide, tartaric acid, sugar alcohols such as mannitol, sorbitol and xylitol and their derivatives, and mixtures thereof. The adjuvants and excipients are preferably chosen from among mono-, di- and poly-saccharides such as glucose, fructose, mannose and lactose and/or saccharose (sucrose) and starches, silicates, PVP, stearates and mixtures thereof.

As an alternative to this, the dry material involves a plant extract or mixtures of such dry extracts of plants, for example from a batch produced previously, onto which liquid plant extract is again sprayed under dry conditions.

The following Examples are intended to illustrate the present invention but do not restrict it in any way.

The Examples were carried out on an IUT 2000 equipment made by the Glatt Inox Company, equipped with a stirrer and chopper, and with different nozzles from the Schlick Company (solid cone nozzles with various nozzle openings and spray valves). The nozzles mentioned below were installed in the usual commercial dryer instead of a flap valve to aerate the reactor below the vapour filtration, and were connected to the reservoir of liquid plant extract. A vacuum was applied to the reactor to suck in the liquid extract. The discharge capacity of the nozzles was adapted to the product-specific evaporation capacity of the IUT 2000 equipment.

EXAMPLE 1

First of all a root extract of *Cimicifuga* with an ethanol content of 50% in water was prepared by conventional methods. As described above, the extract (1200 L) was sucked into the IUT-2000 equipment at a temperature of 25° C. and a vacuum of about 70 mbar through a nozzle with a 0.8 mm aperture, whereby the nozzle created a 60° solid cone. The droplet size was about $\leqq 100\mu$. The evaporator capacity and the discharge capacity were about 150–200 l/h. An adjuvant proportion of approx. 80% lactose monohydrate was put into the mixing and drying chamber as a starting charge. The vessel shell temperature was set to 40° C. and the vacuum was applied at approx. 70 mbar. Thereafter spraying in of the solution was started.

EXAMPLE 2

Under vacuum and temperature conditions similar to those in Example 1, a 50% (vol./vol.) ethanolic leaf extract of *Plantaginis* (2500 L) *Plantago lanceolata* was dried using a nozzle with a 0.6 mm hole that generated a 120° solid cone at an evaporation capacity and a discharge capacity of about 180 l/h. The droplet size was about 250 $\mu$m. As a result, 1000 kg of concentrated extract was obtained within one day.

EXAMPLE 3

In addition a 60% ethanolic extract (1000 L) of *Phytolacca americana* was dried under vacuum and temperature conditions comparable to Example 1. The nozzle used was a nozzle with a 0.6 mm hole that generated a 120° solid cone. The evaporation capacity was 150 l/h and the discharge capacity was 150 l/h. The droplet size was about 100 $\mu$m. As a result >70% of dry residue was obtained within one day.

The drying of *Cimicifuga* and *Plantaginis* according to the process known from EP-B-0 753 306 was impossible hitherto because of the large amount of foaming in the IUT 2000 equipment. In the case of *Phytolacca* the previous drying time was four days, since because of the foam formation it was necessary to remove the vacuum repeatedly and to break the foam, whereas drying according to the method of the invention required only one day. For *Cimicifuga* and *Plantaginis,* drying times required according to the process of the invention were two days and one day respectively, down to dryness or to a concentrate (*Plantaginis*) respectively.

What is claimed is:

1. Method for obtaining dry extracts under mild conditions, in which a liquid extract is introduced into a vacuum drying equipment having a multi-shaft stirrer extending through a cylindrical mixing and drying chamber and with its own drive, together with a chopper rotating through a stator, and the liquid extract is dried at a vessel shell temperature of 20° C. to 50° C., a product temperature between 20° C. and 40° C., a pressure between 0.5 and 1,000 mbar, a stirrer rotation speed of greater than 0 to 10 rpm and a chopper rotation speed of 200 to 800 rpm, characterized in that the liquid extract is sprayed into the mixing and drying chamber through at least one nozzle above the liquid level in the latter, at a pressure differential of >100 mbar between the drying chamber and the reservoir, whereby the nozzle(s) each create(s) a droplet spray cone of $\geqq 30°$ C. in at least one spatial direction, the average droplet size of the liquid extract sprayed in is $\leqq 300\ \mu$m and the discharge capacity of the nozzle(s) is smaller than or equal to the evaporator capacity the drying equipment.

2. Method according to claim 1 to obtain a dry plant extract from a liquid plant extract.

3. Method according to claim 1 in which the temperature of the liquid plant extract before being sprayed into the mixing and drying chamber is higher than or equal to the product temperature.

4. Method according to claim 1 in which the temperature of the liquid plant extract before being sprayed into the mixing and drying chamber is higher than or equal to the temperature of the vessel shell.

5. Method according to claim 1 in which the nozzle(s) create(s) a rotationally symmetrical droplet scatter cone.

6. Method according to claim 1, whereby the pressure differential is generated by applying a vacuum to the mixing and drying chamber.

7. Method according to claim 1, whereby at least two different liquid extracts are introduced into the mixing and drying chamber simultaneously and/or consecutively through multiple nozzles with at least 2 channels.

8. Method according to claim 1, in which the liquid plant extract contains foam-forming constituents.

9. Method according to claim 8, in which the foam-forming constituents represent saponins, soaps and/or proteins.

10. Method according to claim 1, in which the liquid plant extract represents an extract of *Cimicifuga* (Black cohosh, Black snakeroot), *Primula* (primula, primrose), *Valeriana officinalis* (valerian), *Gentiana* (gentian), *Plantaginis* (plantain), *Phytolacca americana, Belane Canda* or mixtures thereof.

11. Method according to claim 1, in which a dry material chosen from the group consisting of usual adjuvants and excipients, dry extract(s) of plants and mixtures thereof is put into the drying chamber as an initial charge before spraying in the liquid plant extract.

12. Method according to claim 11, in which the adjuvants and excipients are selected from among mono-, di- and poly-saccharides, silicates, PVP, stearates and mixtures thereof.

13. Method according to claim 1, whereby the pressure differential is generated by applying a vacuum of 10 to 100 mbar to the drying chamber, the nozzle(s) generate(s) a rotationally symmetrical droplet spray cone of ≧60° C., the average droplet size is ≦150 μm, the discharge capacity of the nozzle(s) is ≧120 l/h and is essentially identical to the evaporator capacity of the vacuum drying equipment, and the temperature of the liquid extract before being sprayed in is higher than the product temperature and lies in a range from 30° C. to 80° C.

14. Method according to claim 13, whereby a dry extract of *Cimicifuga* (Black cohosh, Black snakeroot), *Primula* (primula, primrose), *Valeriana officinalis* (valerian), *Gentiana* (gentian), *Plantaginis* (plantain), *Phytolacca americana, Belane Canda* or mixtures thereof is put into the drying chamber as an initial charge.

* * * * *